US006976748B2

(12) United States Patent
Yabe et al.

(10) Patent No.: US 6,976,748 B2
(45) Date of Patent: Dec. 20, 2005

(54) INK JET HEAD AND PRINTER

(75) Inventors: Kenji Yabe, Kanagawa (JP); Mineo Kaneko, Tokyo (JP); Ken Tsuchii, Kanagawa (JP); Nobuyuki Hirayama, Kanagawa (JP); Masaki Oikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 10/419,140

(22) Filed: Apr. 21, 2003

(65) Prior Publication Data

US 2004/0021731 A1 Feb. 5, 2004

(30) Foreign Application Priority Data

Apr. 23, 2002 (JP) ..... 2002-121205
Apr. 18, 2003 (JP) ..... 2003-114516

(51) Int. Cl.[7] ..... B41J 2/21
(52) U.S. Cl. ..... 347/43; 347/40
(58) Field of Search ..... 347/43, 15, 40, 347/12

(56) References Cited

U.S. PATENT DOCUMENTS 5,208,605 A 5/1993 Drake
5,412,410 A * 5/1995 Rezanka ..... 347/15
5,956,056 A 9/1999 Kaneko et al.
6,030,065 A * 2/2000 Fukuhata ..... 347/15
6,109,715 A 8/2000 Masaki
6,305,080 B1 10/2001 Komuro et al.
6,412,920 B1 7/2002 Matsumoto et al.
6,474,790 B2 11/2002 Kaneko
6,575,560 B2 6/2003 Kaneko et al.
6,595,622 B2 * 7/2003 Yamamoto ..... 347/44
6,616,267 B2 * 9/2003 Weijkamp ..... 347/43
2002/0008729 A1 1/2002 Kaneko et al.
2002/0030716 A1 3/2002 Watanabe et al.
2002/0048477 A1 4/2002 Udagawa et al.

FOREIGN PATENT DOCUMENTS

EP 1 110 743 6/2001
EP 1 228 876 8/2002
JP 9-164706 6/1997
JP 11-179920 7/1999
JP 2000-6442 1/2000
JP 2001-63029 3/2001

OTHER PUBLICATIONS

Pending U.S. Appl. No. 10/419,176, filed Apr. 21, 2003, Kenji Yabe.
Pending U.S. Appl. No. 10/419,839, filed Apr. 22, 2003, Ken Tsuchii, et al.
Pending U.S. Appl. No. 10/420,920, filed Apr. 23, 2003, Mineo Kaneko, et al.

* cited by examiner

*Primary Examiner*—Lamson Nguyen
(74) *Attorney, Agent, or Firm*—Fitzpatrick, Cella, Harper & Scinto

(57) ABSTRACT

Since the large amount nozzle arrays are disposed at first columns and the small amount nozzle arrays are disposed at second columns on both sides of the shifting directions along the main scan direction, the deflection of the ink droplet caused by the first air flows is totally reduced.

11 Claims, 8 Drawing Sheets

INK JET HEAD AND PRINTER

BACKGROUND OF THE INVENTION

1. Field of the Invention

The present invention relates to an ink jet head of an ink jet printer, and more particularly, it relates to an ink jet head in which a plurality of ink nozzles are disposed along a sub scan direction in each of plural nozzle arrays disposed along a main scan direction.

2. Related Background Art

In recent years, ink jet printers have been generally popularized as printer apparatuses, and high speed printing and high quality printing of the printer have been requested. In a general ink jet printer, by shifting a print medium in a sub scan direction while shifting an ink jet head in a main scan direction, a dot matrix image is formed on the print medium by ink droplets discharged from the ink jet head.

In the general ink jet head, plural ink nozzles are disposed along the sub scan direction in a nozzle array, and, in a full-color ink jet head, first to third primary color nozzle arrays for individually discharging three primary color ink droplets are disposed side by side in the main scan direction. With this arrangement, although the ink jet head can form a color image having good color and a high resolving power at a high speed, nowadays, further high image quality has been requested. To this end, as means for printing the high quality image, there has been a technique in which dense ink and sparse ink are used as the same color ink. Further, although the high image quality can be achieved by decreasing a diameter of each ink nozzle, it is not desirable, because a print speed is reduced in comparison with the conventional technique if the nozzles are not disposed with high density and many nozzles are not prepared. Further, in many cases, although gradation expression achieved by changing an amount of the ink droplet is performed by using the same nozzle in the prior art, in order to permit the gradation using the same nozzle, it is difficult that the image quality is elevated to the lever achieved by using the dense and sparse inks due to limitation of arranging density and limitation of the small liquid droplet miniaturization caused by limitation of layouts of heat generating elements and wirings.

SUMMARY OF THE INVENTION

By reducing a discharge amount of the small liquid droplet sufficiently and by providing a large droplet discharging nozzle and a small droplet discharging nozzle separately in order to enhance the integrated degree, the discharge amount of the small liquid droplet can be made to a desired level.

In order to achieve such an image having the high resolution image, although the large droplet discharging nozzle and the small droplet discharging nozzle are integrated on a single substrate, the Inventors found that, for example, if the discharge amount of the small liquid droplet becomes about 2 pl, the droplet is apt to be influenced by an air flow to worsen accuracy of dot placement.

Accordingly, an object of the present invention is to provide an ink jet head in which influence of an air flow affecting upon small droplet discharging nozzle is reduced thereby to form a high quality image by installing a large droplet discharging nozzle and a small droplet discharging nozzle in consideration of the influence of the air flow.

The present invention provides an ink jet head which is shifted in a main scan direction at a position opposed to a print medium shifted in a sub scan direction and in which, when the head is shifted in the main scan direction, an ink droplet is discharged from any ink nozzle toward the print medium, the head comprising a plurality of first nozzle arrays including nozzles arranged along the main scan direction and adapted to discharge ink droplets and a plurality of second nozzle arrays including nozzles for discharging ink droplets each having an amount smaller than that of the first nozzle arrays arranged in the main scan direction and wherein the first nozzle arrays are disposed adjacent to and on both sides of the second nozzle array.

With this nozzle arrangement, in the ink jet head according to the present invention, influence of an air flow of the adjacent nozzles in the small amount nozzle array affecting upon the ink droplet can be reduced.

BRIEF DESCRIPTION OF THE DRAWINGS

FIG. 2A is a plan view of a silicon substrate and FIG. 2B is a longitudinal sectional front view of the ink jet head;

DESCRIPTION OF THE PREFERRED EMBODIMENTS (Construction of Embodiment)

Figure 1:
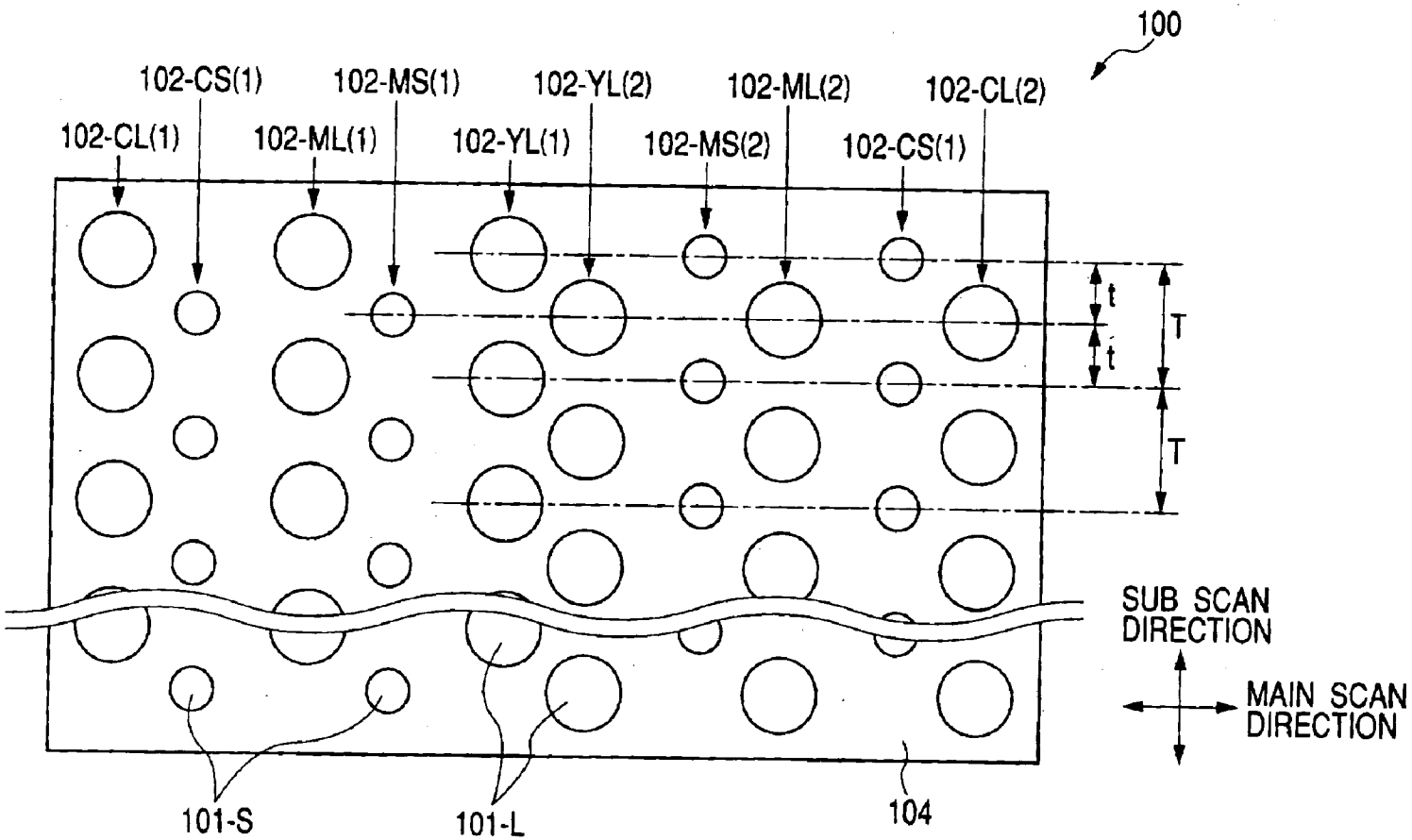
FIG. 1 is a plan view showing an ink nozzle pattern of an ink jet head according to an embodiment of the present invention.

Now, an embodiment of the present invention will be explained with reference to FIGS. 1 to 5. As shown in FIG. 1, an ink jet head 100 according to this embodiment is of reciprocal type capable of coping with full-color printing and, in this head, ten nozzle arrays 102 each including a plurality of ink nozzles 101 arranged in a sub scan direction are arranged in main scan direction.

More specifically, in the ink jet head 100 according to the illustrated embodiment, the ten nozzle arrays 102 comprise nozzle arrays 102-Y, 102-M and 102-C for discharging ink droplets D-Y, D-M and D-C having respective Y, M and C colors as three primary colors, respectively, and the nozzle arrays 102-Y, 102-M and 102-C for Y, M and C colors are symmetrically disposed with respect to the nozzle arrays for Y color along the main scan direction.

Further, in the ink jet head 100 according to the illustrated embodiment, the ten nozzle arrays 102 include a plurality of large amount nozzle arrays 102-L for discharging an ink droplet D-L having a predetermined first liquid amount, and a plurality of small amount nozzle arrays 102-S for discharging an ink droplet D-S having a second liquid amount smaller than the first liquid amount.

For example, the first liquid amount of the ink droplet D-L is "5 pl (pico-liter)" and the second liquid amount of the ink droplet D-S is "2 (pl)". Incidentally, to simplify the explanation hereinafter, the first liquid amount is referred to as "large amount" and the second liquid amount is referred to as "small amount".

More specifically, the C and M nozzle arrays 102-C and 102-M include large amount nozzle arrays 102-CL and 102 ML and small amount nozzle arrays 102-CS and 102-MS; whereas, the Y nozzle arrays 102-Y include only large amount nozzle arrays 102-YL.

Since such nozzle arrays 102 are arranged symmetrically with respect to the Y nozzle arrays in the main scan direction as mentioned above, in the ink jet head 100 according to the illustrated embodiment, the nozzle arrays 102-CL(1), 102-CS(1), 102-ML(1), 102-MS(1), 102-YL(1), 102-YL(2), 102-MS(2), 102-ML(2), 102-CS(2) and 102-CL(2) are arranged in order from one end to the other end of the main scan direction.

Thus, in the ink jet head 100 according to the illustrated embodiment, regarding the shifting direction along the main scan direction, the large amount nozzle arrays 102-L are disposed in at least first columns and the small amount nozzle arrays 102-S are disposed in second columns. Incidentally, the ink nozzle 101-L for discharging the large amount ink droplet D-L has a circular shape having a diameter of "16 (μm)" for example and the ink nozzle 101-S for discharging the small amount ink droplet D-S has a circular shape having a diameter of "10 (μm)" for example.

Further, although the Y, M and C nozzle arrays 102-Y, 102-M and 102-C are arranged symmetrically along the main scan direction, in the nozzle arrays 102-(1) and 102-(2) having the same diameters and adapted to discharge the same color ink droplets D and disposed at the left and right sides in FIG. 1, periods "T" of arrangement of the ink nozzles 101 are the same, but phases "t" are deviated by a half period, i.e. "t=T/2".

Incidentally, in the Y, M and C, by using the large and small arrays regarding M and C and using only the large arrays regarding Y, a driving-in (discharging) amount of the liquid droplet can be reduced in comparison with the formation of the image using the dense and sparse inks. In particular, by selecting the liquid amount of the small droplet smaller than 1 pl, even when the image quality is greatly influenced by difference in the droplet liquid amount, the same image quality can be achieved as the usage of the dense and sparse inks.

Incidentally, in the ink jet head 100 according to the illustrated embodiment, since the ink nozzles 101 are arranged with density of "600 dpi (dot per inch)" in each nozzle array 102, the period "T" of the arrangement of the ink nozzles 101 becomes about "42 (μm)".

Further, in the ink jet head 100 according to the illustrated embodiment, arrangement pitch of the large amount nozzle arrays 102-L and arrangement pitch of the small amount nozzle arrays 102-S are "1.376 (mm)", and arrangement pitch of the adjacent same color nozzle arrays 102 is "0.254 (mm)". In this case, an ink supply port 111 is disposed between the adjacent large amount nozzle array 102-L and small amount nozzle array 102-S.

Namely, the large amount nozzles 101-L and the small amount nozzles 101-S corresponding to the same ink supply port 111 are staggered with a period of about "21 (μm)" along the main scan direction. Further, the small amount nozzles 101-S in the small amount nozzle array 102-S are arranged to be pinched between the large amount nozzles 101-L on both sides of the main scan direction.

Figure 2A:
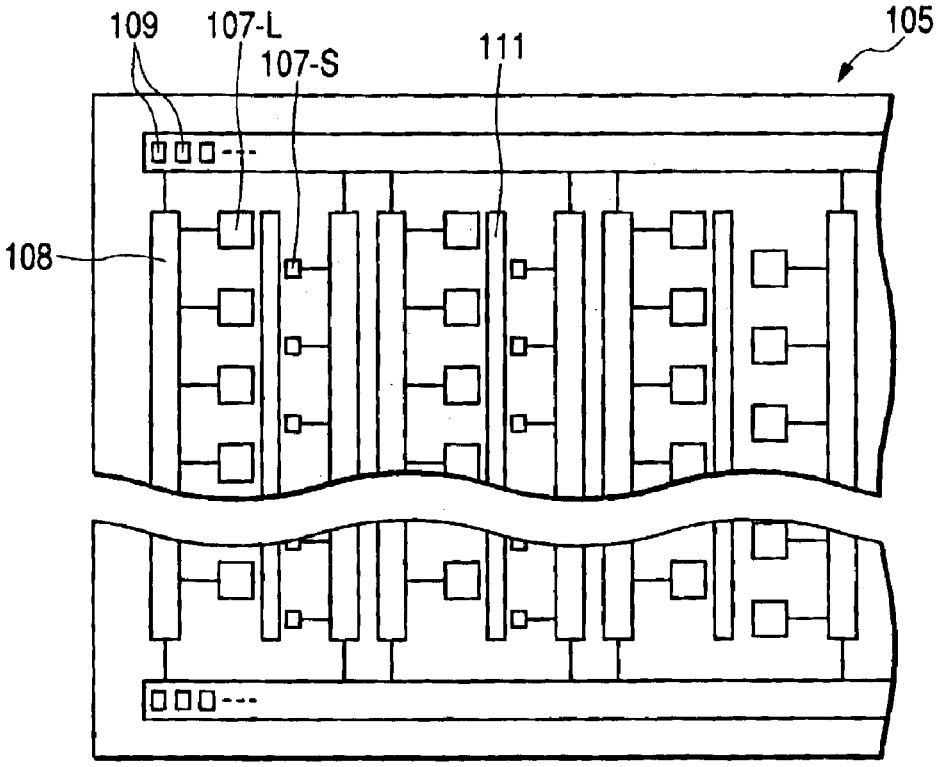
FIGS. 2A and 2B are views showing an internal structure of the ink jet head, where
Figure 2B:
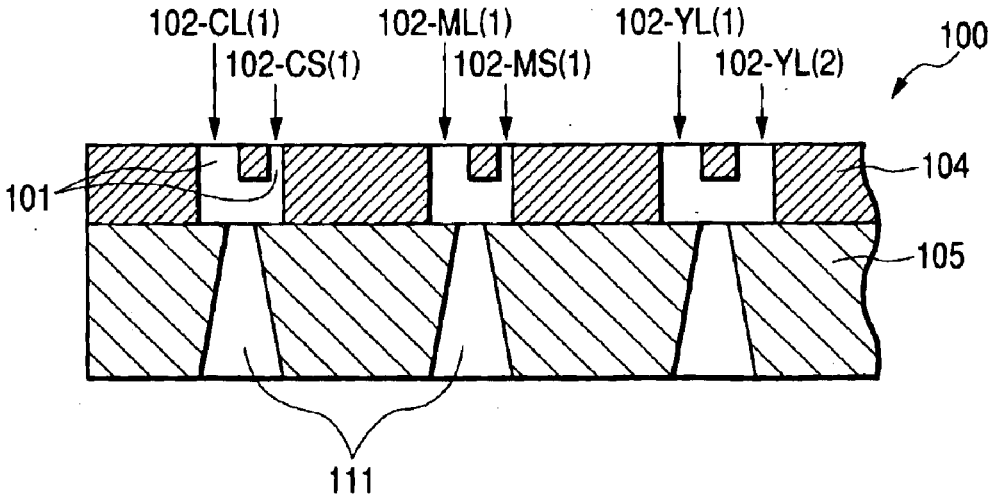

As shown in FIG. 2B, the ink jet head 100 according to the illustrated embodiment has an orifice plate 104 and a silicon substrate 105 which are laminated. The ink nozzles 101 are formed in the orifice plate 104 are integrally communicated with each other within the interior of the orifice plate 104 regarding the adjacent same color nozzle arrays 102.

For example, the silicon substrate 105 comprises silicon (100) and, as shown in FIG. 2A, heat generating elements 107 as ink discharging means are formed on a surface of the substrate in correspondence to positions of the ink nozzles 101. The ink droplet D is discharged from the ink nozzle 101 by causing ink bubbling by means of the heat generating element 107.

However, since there are large and small ink nozzles 101 as mentioned above, first heat generating elements 107-L having a first area of "26×26 (μm)" are formed at positions corresponding to the large diameter ink nozzles 101-L and second heat generating elements 107-S having a second area of "22×22 (μm)" are formed at positions corresponding to the small diameter ink nozzles 101-S.

Driving circuits 108 are formed at positions adjacent to the heat generating elements 107 in the main scan direction, and the adjacent heat generating elements 107 are connected to the driving circuit 108. Further, a plurality of connection terminals 109 are formed on the surface of the silicon substrate 105 at positions in the vicinity of both ends in the sub scan direction, and the driving circuits 108 are connected to the connection terminals 109.

Since the ink supply ports 111 for every adjacent same color nozzle arrays 102 are formed in the silicon substrate 105, as shown in FIG. 2B, each ink supply port 111 is communicated with the adjacent same color nozzle arrays 102 commonly. Incidentally, since the ink supply port 111 is formed in the silicon substrate 105 comprised of silicon (100) by anisotropy etching, a cross-sectional shape thereof becomes trapezoidal.

Figure 3:
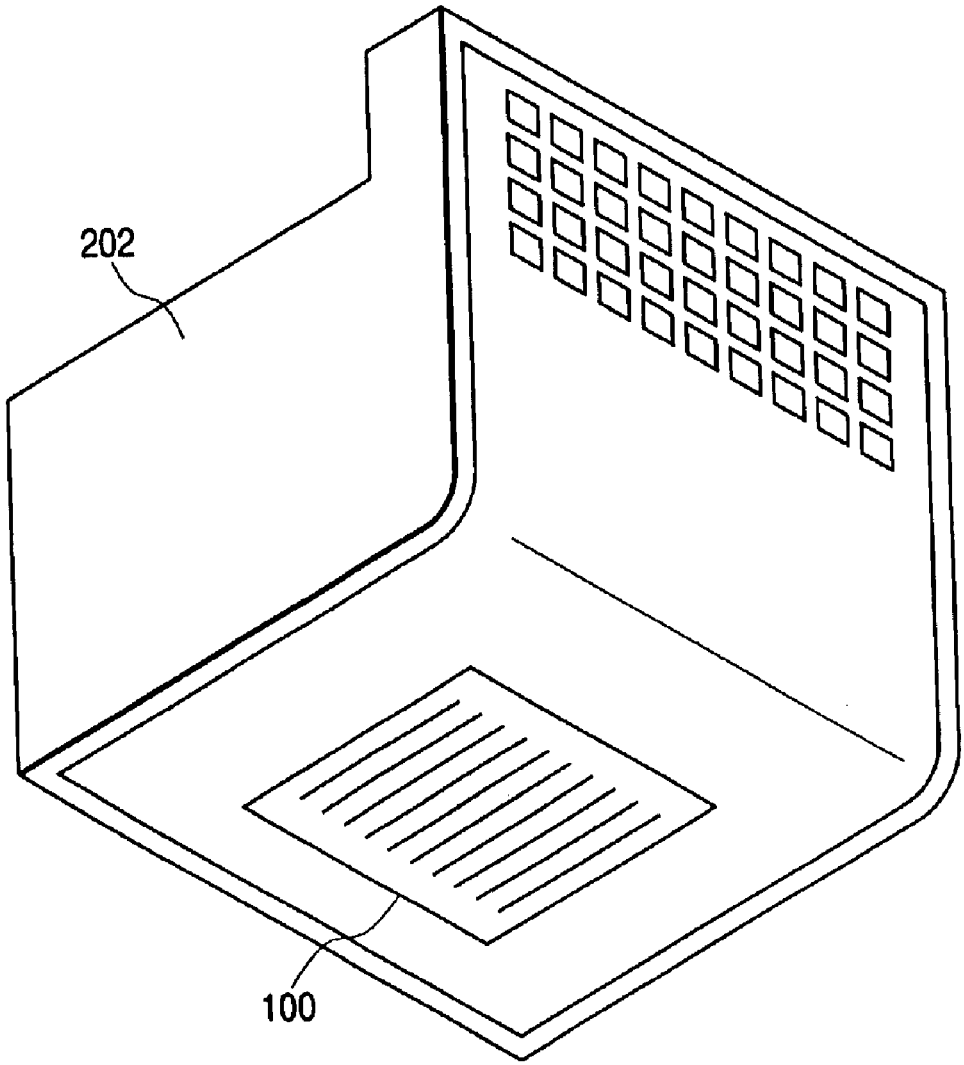
FIG. 3 is a perspective view showing a condition that the ink jet head is mounted to a head main body.
Figure 4:
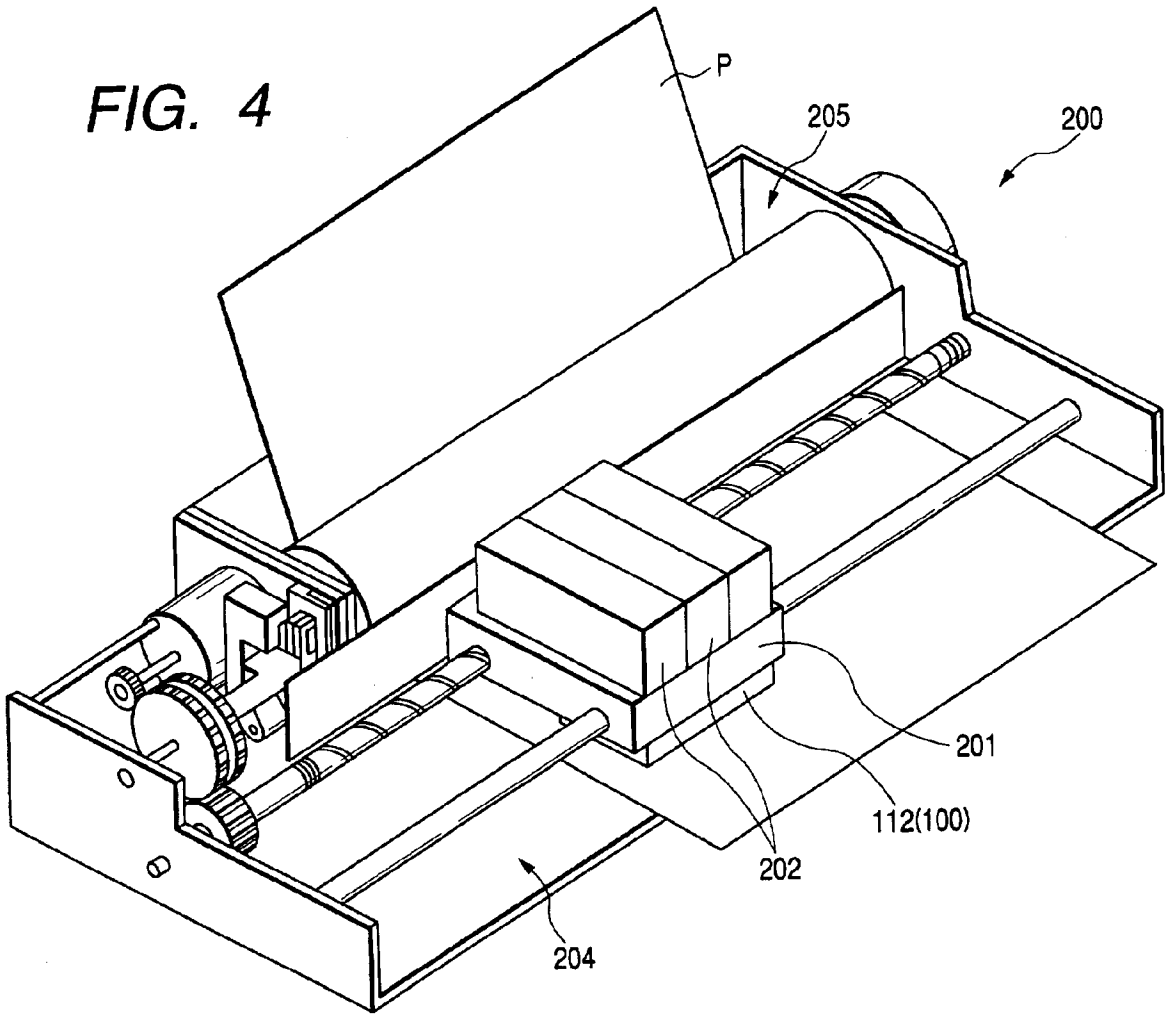
FIG. 4 is a perspective view showing an internal structure of an ink jet printer according to an embodiment of the present invention.
Figure 5:
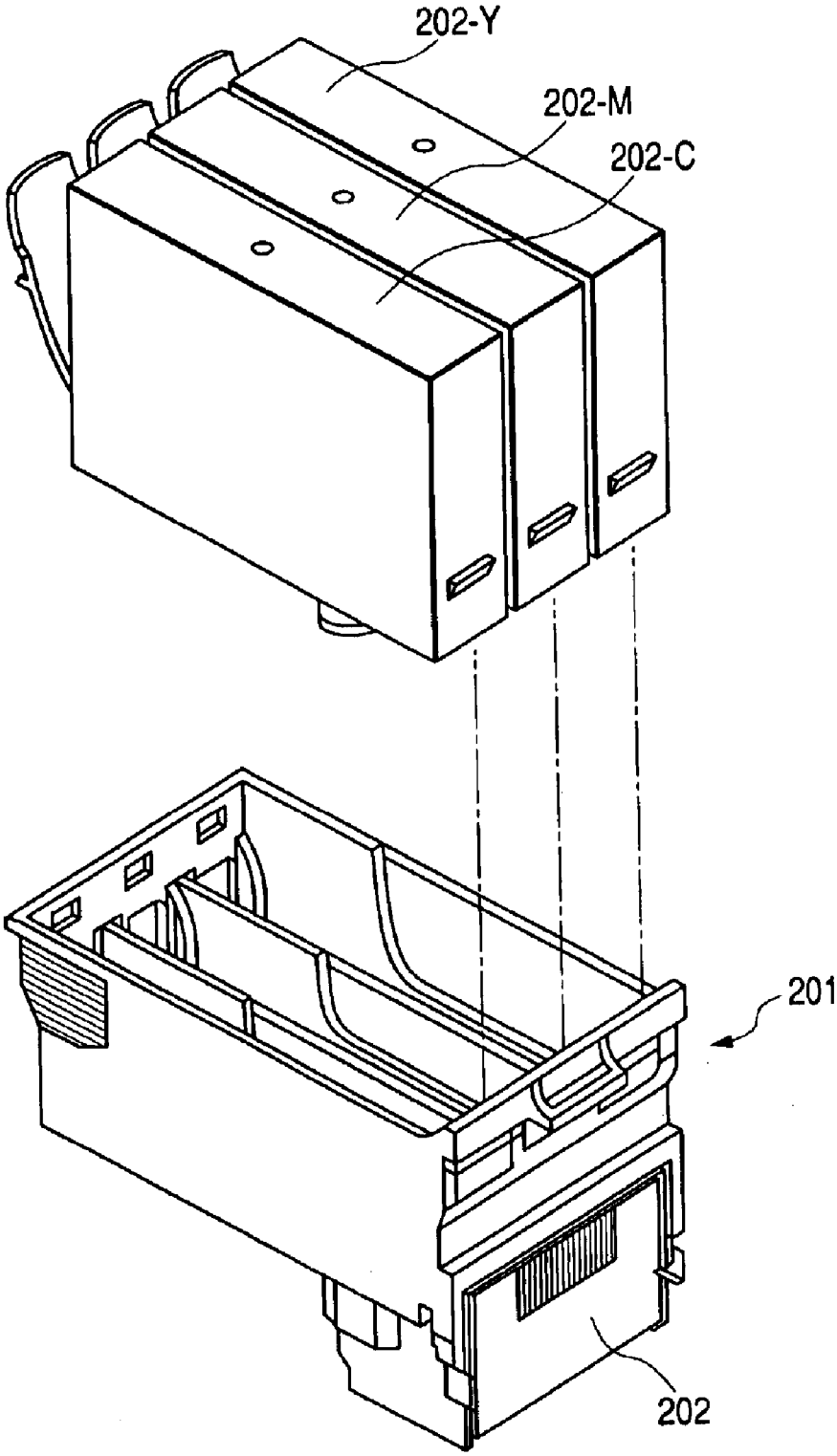
FIG. 5 is an exploded perspective view showing a condition that an ink cartridge is being mounted to a carriage.

As shown in FIGS. 3 to 5, the ink jet head 100 according to the illustrated embodiment is formed as a part of an ink jet printer 200 and is mounted on a carriage 201 of the ink jet printer 200 as shown in FIGS. 4 and 5.

More specifically, as shown in FIG. 3, the ink jet head 100 according to the illustrated embodiment is mounted to a head main body 202, and, as shown in FIG. 5, the head main body 202 is mounted to the carriage 201. Y, M and C ink cartridges 202-Y, 202-M and 202-C are detachably mounted to the carriage 201so that Y, M and C color inks are supplied from these ink cartridges 202-Y, 202-M and 202-C to the Y, M and C nozzle arrays 102-Y, 102-M and 102-C.

Further, as shown in FIG. 4, the ink jet printer 200 according to the illustrated embodiment includes a main scan mechanism 204 and a sub scan mechanism 205, and the main scan mechanism 204 serves to support the carriage 201 for a shifting movement in the main scan direction and the sub scan mechanism 205 serves to shift a print medium P at a position opposed to the ink jet head 100.

Further, the ink jet printer 200 according to the illustrated embodiment has an integration control circuit (not shown) including a microcomputer, driver circuits and the like, and operations of the ink jet head 100, main scan mechanism 204 and sub scan mechanism 205 are controlled integrally or totally by means of the integration control circuit.

In the above-mentioned arrangement, the ink jet printer 200 according to the illustrated embodiment can form a color image on a surface of the print medium P. In this case, the print medium P is shifted in the sub scan direction by the sub scan mechanism 205 and the ink jet head 100 is reciprocally shifted in the main scan direction by the main scan mechanism 204. In this case, since the ink droplets D are discharged onto the print medium P from the ink nozzles 101 of the ink jet head 100, a dot matrix color image is formed by adhereing the ink droplets D to the print medium P.

In the ink jet printer 200 according to the illustrated embodiment, plural operation modes are set in a changeable manner and various printing operations are performed in correspondence to the operation modes. For example, in a high image quality mode as a fundamental mode, when the ink jet head 100 is reciprocally shifted in the main scan direction, all of the nozzle arrays 102 are activated in the forward stroke and the rearward stroke.

As shown in FIG. 1, regarding the ink jet head 100 according to the illustrated embodiment, as mentioned above, in the nozzle arrays 102-(1) and 102-(2) having the same diameters and adapted to discharge the same color ink droplets D and disposed at the left and right sides in FIG. 1, the periods "T" of arrangement of the ink nozzles 101 are the same and the phases are deviated by the half period "t". Thus, as mentioned above, by activating all of the nozzle arrays 102, pixels generated by the ink droplets D can be arranged on the print medium P with the period of "t" in the sub scan direction.

Further, in the ink jet printer 200 according to the illustrated embodiment, a secondary color can be formed falsely by adjusting density of Y, M and C color pixels, and, in the ink jet head 100 according to the illustrated embodiment, regarding the M and C colors, the large amount ink droplet D-L and the small amount ink droplet D-S are selectively discharged. Thus, since M color large and small pixels and C color large and small pixels can be formed freely, the density of the secondary color pixels falsely formed can be increased.

In this case, average dot diameters of the large amount ink droplet D-L and the small amount ink droplet D-S on the print medium P are within about 48 $\mu$m and about 36 $\mu$m, respectively.

Incidentally, regarding the Y color, although only the large amount ink droplets D-L are discharged, since the Y color is akin to a white color of the print medium P, it is less necessary to form the large and small pixels.

Incidentally, in order to realize further high image quality, it is proper that the dot diameter of the small amount ink droplet D-S be about 20 $\mu$m. The reason is that, in a view point of pixel recognition ability, a lower limit is reached by the dot diameter of about 20 $\mu$m. Regarding this, when it is assumed that the ink droplet is driven in a paper having a blur rate of about 2%, the discharging amount corresponds to about 0.5 pl.

Further, regarding a combination of the small amount ink droplet D-S and the large amount ink droplet D-L, it is preferable that the large amount be greater than the small amount by integral number (greater than 2) times in order to achieve high gradation.

Among the plural operation modes, in a high speed mode, when the ink jet head 100 is reciprocally shifted in the main scan direction, only the large amount nozzle arrays 102-L are activated in the forward and rearward strokes. In this case, it is preferable that a distance between the nozzle arrays is widened so that the plurality of respective large amount nozzle arrays 102-L are not influenced by air flows in shifting directions of the ink droplets D. Namely, as the arranging order of the large amount nozzle arrays 102-L and small amount nozzle arrays 102-S corresponding to the same ink supply port 111, the illustrated embodiment in which the large amount nozzles are disposed on both ends in the main scan direction is preferred.

Now, the influence of the air flow will be explained with reference to FIG. 6.

In the ink jet head 100 according to the illustrated embodiment, as mentioned above, the large amount nozzle arrays 102-L are disposed at the first columns and the small amount nozzle arrays 102-S are disposed at the second columns regarding the shifting directions along the main scan direction, and the large amount nozzle arrays 102-L are also disposed at third columns regarding the shifting directions along the main scan direction. Namely, the large amount nozzle arrays 102-L are disposed on both side of each small amount nozzle arrays 102-S disposed at each second column.

Figure 6:
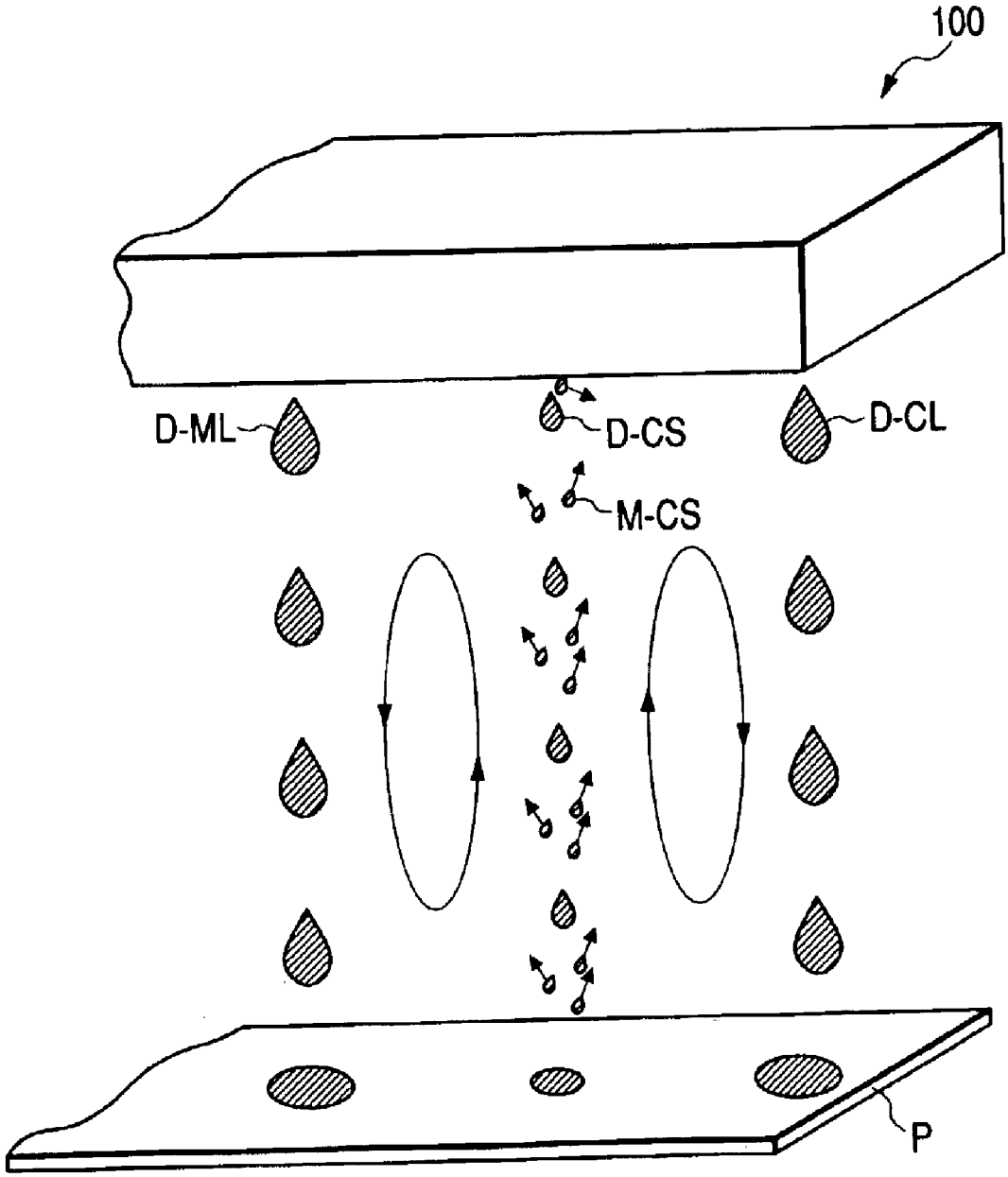
FIG. 6 is a schematic view showing a condition that ink mist is collected by swivel air flows.

With this arrangement, as shown in FIG. 6, air flows caused by the large amount nozzle arrays are generated on both sides of the small amount nozzle array. Although such air flows affect an influence upon the dot placement accuracy of the small amount nozzle, in comparison with a case where the large amount nozzle is disposed only at one side of the small amount nozzle, when the large amount nozzles are disposed on both side of the small amount nozzle, since the small amount nozzle is influenced by the air flows from both large amount nozzles, the droplet is not deviated or offset toward one side, thereby stabilizing the image.

Further, when the small droplet is discharged, although there is a tendency that a mist amount for the main droplet in comparison with the large droplet discharging increases, the floating mist generated upon discharging of the small droplet can be shifted toward the head by the influence of the air flows of the large nozzles disposed on both sides of the small droplet nozzle.

In the illustrated embodiment, since the large amount nozzle arrays are disposed on both sides of all small amount nozzle arrays, the high quality print is permitted.

(Alterations of Embodiment)

Figure 7:
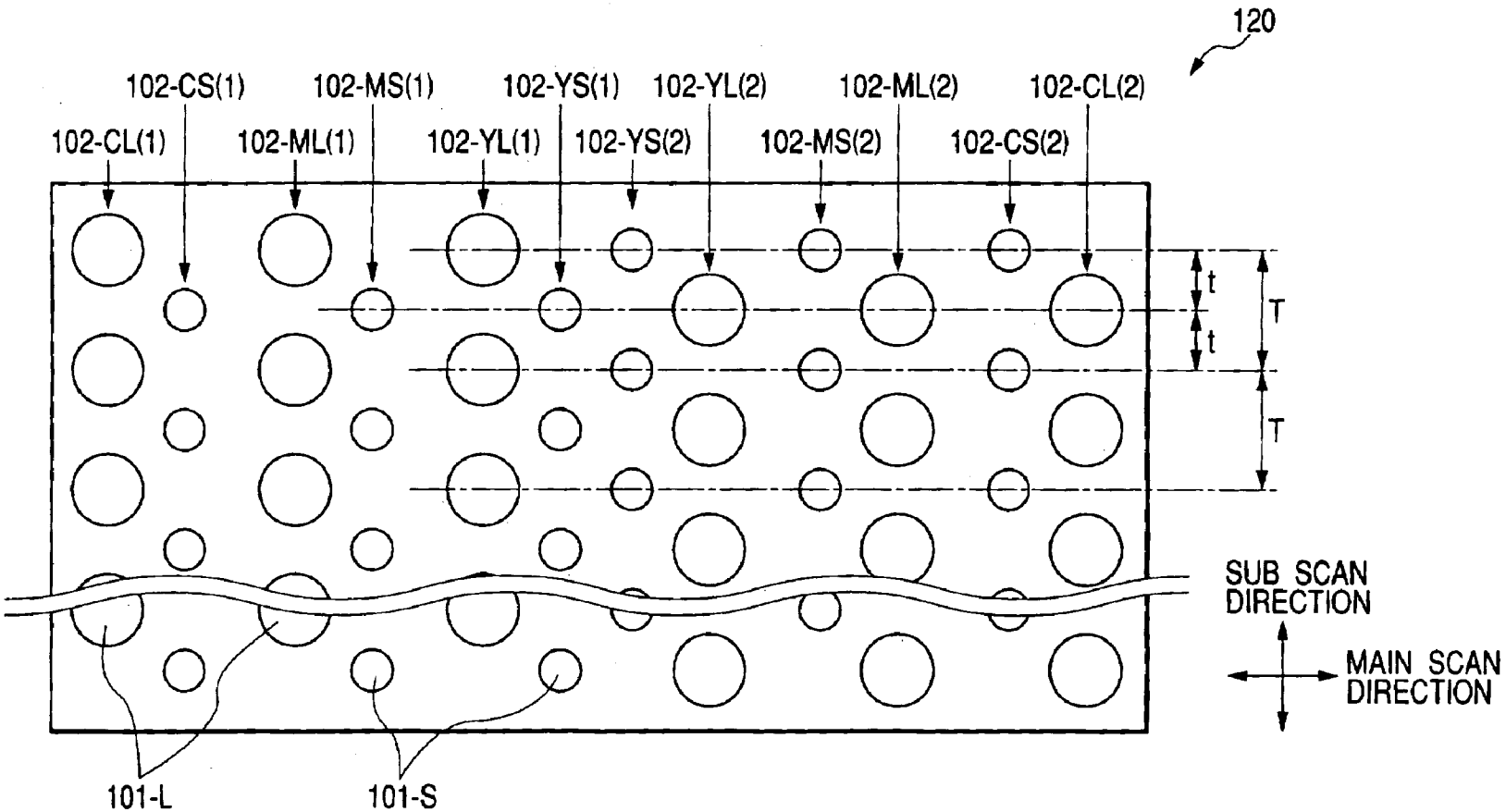
FIG. 7 is a plan view showing an ink nozzle pattern of an ink jet head according to a first alteration.

The present invention is not limited to the above-mentioned embodiment, and various alterations can be made without departing from the scope of the invention. For example, in the above-mentioned embodiment, while an example that the construction of the ink jet head 100 is simplified by providing only the large amount nozzle arrays 102-YL(1) and 102-YL(2) for the Y color which affects less influence upon the image quality was explained, as is in an ink jet head 120 shown in FIG. 7, for all of Y, M and C colors, the large amount nozzle arrays 102-L(1) and 102-L(2) and the small amount nozzle arrays 102-S(1) and 102-S(2) can be provided.

Further, in the above-mentioned embodiment, while an example that the Y, M and C nozzle arrays 102 are provided in the ink jet head 100 was explained, K (black) nozzle arrays 102 may further be added and/or nozzle arrays 102 for a color or colors other than the Y, M and C colors may be added (both not shown).

Similarly, in the above-mentioned embodiment, while an example that only the ink jet head 100 for the Y, M and C colors is mounted to the ink jet printer 200 was explained, an ink jet head for a K color may further be mounted and/or ink jet head(s) for color(s) other than the Y, M and C colors may be mounted (both not shown).

Further, in the above-mentioned embodiment, while an example that, when the ink jet printer 200 reciprocally shifts the ink jet head 100 in the main scan direction, all of the nozzle arrays 102 are always activated was explained, for example, when the ink jet head 100 is shifted to the right in FIG. 1, only the right side nozzle arrays 102-(1) may be activated, and, when the head is shifted to the left, only the left side nozzle arrays 102-(2) may be activated.

Further, in the above-mentioned embodiment, while an example that the nozzle arrays are disposed symmetrically on the ink jet head 100 in the main scan direction and the ink jet head 100 is operated in both the forward and rearward strokes of the reciprocal shifting movement along the main scan direction was explained, for example, only when an ink jet head (not shown) having a construction corresponding to the right half of FIG. 1 is shifted to the right, the head may be operated.

Figure 8:
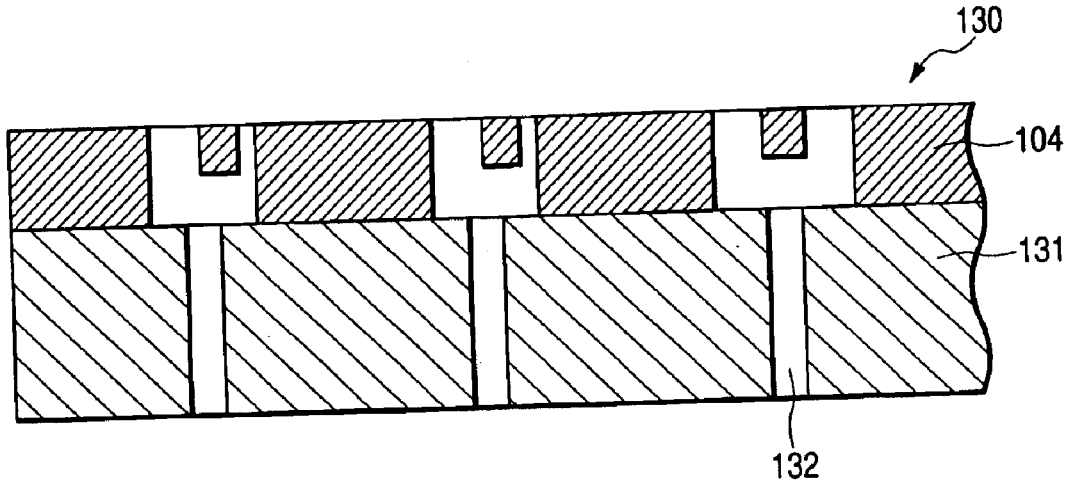
FIG. 8 is a longitudinal sectional front view showing an internal structure of an ink jet head according to a second alteration.

Further, in the above-mentioned embodiment, while an example that each of the ink supply ports 111 has the trapezoidal cross-sectional shape by forming the ink supply ports in the silicon substrate 105 made of silicon (100) by the anisotropy etching was explained, as is in an ink jet head 130 shown in FIG. 8, by forming ink supply paths 132 in the silicon substrate 105 made of silicon (100) by the anisotropy etching, each of the ink supply paths may have a straight cross-sectional shape. Further, by forming the ink supply paths by laser processing or sand blast other than the anisotropy etching, each of the ink supply paths may have the straight shape regardless of the face orientation of the silicon substrate.

Further, in the above-mentioned embodiment, while an example that the large and small ink nozzle arrays 102-L and 102-S and the large and small heat generating elements 107-L and 107-S are combined to discharge the large and small ink droplets D was explained, for example, the large and small heat generating elements 107-L and 107-S may be combined with ink nozzle arrays 102 having a fixed size or heat generating elements 107 having a fixed size may be combined with the large and small ink nozzle arrays 102.

Further, in the above-mentioned embodiment, while an example of the heat generating elements 107 was illustrated as the ink discharging means for discharging the ink droplets D from the ink nozzles 101, in place of the heat generating elements, vibrating elements (not shown) may be used. Further, in the above-mentioned embodiment, while various numerical values were concretely indicated, of course, the indicated values may be changed.

As mentioned above, in the ink jet head according to the present invention, since the large amount nozzle arrays are disposed on both sides of each small amount nozzle array in the shifting directions along the main scan direction, deflection of the discharging direction of the ink droplet caused by the air flow can be totally reduced in average, with the result that relative displacement between the dot placement positions of the ink droplets discharged from the plural nozzle arrays can be prevented, thereby enhancing the quality of the print image.

Furthermore, in the ink jet head 100 according to the present invention, when the color image is formed, since the large amount ink droplet D-L and the small amount ink droplet D-S can selectively be used, density of secondary color pixels of the image to be formed can be increased, thereby achieving the good image quality. In addition, when only the large amount nozzle arrays 102-YL(1) and 102-YL (2) are used for the Y color which affects less influence upon the image quality, the construction of the head can be simplified, with the result that the weight of the head can be reduced and productivity can be enhanced.

Further, in the ink jet head 100 according to the present invention, two same color nozzle arrays 102 are provided for each color and the ink supply port 111 is communicated with the two respective same color nozzle arrays 102. Thus, the number of the ink supply ports is reduced, with the result that the construction of the ink jet head 100 is simplified and productivity can be enhanced.

What is claimed is:

1. An ink jet head which is shifted in a main scan direction at a position opposed to a print medium shifted in a sub scan direction and in which, when said head is shifted in the main scan direction, an ink droplet is discharged from an ink nozzle toward the print medium, the ink nozzle belonging to either one of the following pluralities of nozzle arrays, said head comprising:

a plurality of first nozzle arrays including nozzles for discharging a predetermined volume of liquid droplet and arranged along the main scan direction; and a plurality of second nozzle arrays including nozzles for discharging ink droplets each having an amount smaller than that of said first nozzle arrays and arranged in the main scan direction, wherein each nozzle array of said plurality of first nozzle arrays is arranged adjacent to a nozzle array of said plurality of second nozzle arrays, and each nozzle array of said plurality of second nozzle arrays is disposed between two nozzle arrays of said plurality of first nozzle arrays.

2. An ink jet head according to claim 1, wherein at least one of said adjacent first nozzle arrays discharges ink having a color different from a color of ink discharged from said adjacent second nozzle array.

3. An ink jet head according to claim 1, wherein said plurality of first nozzle arrays and said plurality of second nozzle arrays are symmetrically arranged about at least one central nozzle array as a center with respect to a main scan direction.

4. An ink jet head according to claim 1, wherein said adjacent first and second nozzle arrays are communicated with a common ink supply port.

5. An ink jet head according to claim 1, wherein said head is reciprocally shifted in the main scan direction, and said first nozzle arrays are disposed at first columns and said second nozzle arrays are disposed at second columns on both sides in the reciprocal directions.

6. An ink jet head according to claim 1, wherein an orifice plate in which at least said nozzle arrays are formed is laminated with a silicon substrate in which ink supply ports are formed, and said silicon substrate is made of silicon (110).

7. An ink jet printer comprising:

an ink jet head according to claim 1;

a main scan mechanism for shifting said ink jet head in a main scan direction;

a sub scan mechanism for shifting a print medium in a sub scan direction at a position opposed to said ink jet head; and an integration control circuit for integrally controlling operations of said ink jet head, said main scan mechanism and said sub scan mechanism.

8. An ink jet head according to claim 1, wherein said plurality of first and second nozzle arrays are formed on a same substrate.

9. An ink jet head which has nozzles for ink droplets for Y (yellow), M (magenta) and C (cyan) colors independently and which is shifted in a main scan direction at a position opposed to a print medium shifted in a sub scan direction and in which, when said head is shifted in the main scan direction, an ink droplet is discharged from an ink nozzle toward the print medium, said head comprising:

a plurality of first nozzle arrays including nozzles arranged along the main scan direction and adapted to discharge ink droplets; and a plurality of second nozzle arrays including nozzles for discharging ink droplets each having an amount smaller than that of said first nozzle arrays arranged in the main scan direction, wherein said nozzles for the C and M colors comprise nozzles from said plurality of first nozzle arrays and said plurality of second nozzle arrays, and said nozzles for the Y color comprise nozzles from said plurality of first nozzle arrays, wherein nozzle arrays for the M and C colors are symmetrically arranged about at least one nozzle array for the Y color with respect to the main scan direction, and said second nozzle arrays are arranged at a side of said at least one nozzle array for said Y color.

10. An ink jet head according to claim 9, wherein an ink supply port is commonly communicated with adjacent nozzle arrays for the same color.

11. An ink jet printer comprising:

an ink jet head according to claim 9;

a main scan mechanism for shifting said ink jet head in a main scan direction;

a sub scan mechanism for shifting a print medium in a sub scan direction at a position opposed to said ink jet head; and an integration control circuit for integrally controlling operations of said ink jet head, said main scan mechanism and said sub scan mechanism.

* * * * *